US011674249B2

(12) United States Patent
Takamura et al.

(10) Patent No.: US 11,674,249 B2
(45) Date of Patent: Jun. 13, 2023

(54) SEWING DEVICE AND SEWING METHOD

(71) Applicant: HONDA MOTOR CO., LTD., Tokyo (JP)

(72) Inventors: Toru Takamura, Tochigi-ken (JP); Yosuke Ikadai, Tochigi-ken (JP); Mitsutaka Igaue, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 333 days.

(21) Appl. No.: 17/261,586

(22) PCT Filed: Jun. 28, 2019

(86) PCT No.: PCT/JP2019/025918
§ 371 (c)(1),
(2) Date: Jan. 20, 2021

(87) PCT Pub. No.: WO2020/026667
PCT Pub. Date: Feb. 6, 2020

(65) Prior Publication Data

US 2021/0292951 A1 Sep. 23, 2021

(30) Foreign Application Priority Data

Aug. 2, 2018 (JP) ..... JP2018-145779

(51) Int. Cl.
*D05B 39/00* (2006.01)
*D05B 31/00* (2006.01)
*D05B 69/30* (2006.01)

(52) U.S. Cl.
CPC ..... *D05B 39/00* (2013.01); *D05B 31/00* (2013.01); *D05B 69/30* (2013.01); *D05D 2207/04* (2013.01)

(58) Field of Classification Search
CPC ..... D05B 31/00; D05B 69/30; D05B 39/00
See application file for complete search history.

(56) References Cited

U.S. PATENT DOCUMENTS 4,915,040 A * 4/1990 Sakuma ..... D05B 39/00 112/63
5,381,743 A * 1/1995 Moll ..... D05B 23/00 112/470.13

(Continued)

FOREIGN PATENT DOCUMENTS

JP 2017-071382 4/2017
JP 6151117 6/2017
JP 2017-197163 11/2017

OTHER PUBLICATIONS

International Search Report and Written Opinion for International Application No. PCT/JP2019/025918 dated Sep. 24, 2019, 10 pages.

*Primary Examiner* — Nathan E Durham
(74) *Attorney, Agent, or Firm* — Amin, Turocy & Watson, LLP

(57) ABSTRACT

Provided are: a sewing device provided with a sewing mechanism which performs sewing on a work to be sewn using a sewing-machine needle, while holding the work to be sewn in a state of being shaped in a predetermined shape on a plurality of seating portions arranged in a sewing direction; and a sewing method. When the seating portions are withdrawn from the work to be sewn so as to avoid interference between the sewing mechanism and the seating portions, a guiding mechanism enables movement in a first withdrawing direction for avoiding a first undercut portion of the work to be sewn, and movement in a second withdrawing direction for avoiding a second undercut portion of the work to be sewn.

7 Claims, 6 Drawing Sheets

(56) References Cited

U.S. PATENT DOCUMENTS

| | | | | | |
|---|---|---|---|---|---|
| 5,419,268 | A * | 5/1995 | Fyler | D05B 23/00 | 112/470.14 |
| 5,988,085 | A * | 11/1999 | Martz | D05B 39/00 | 112/475.08 |
| 6,129,031 | A * | 10/2000 | Sarh | D05B 25/00 | 901/41 |
| 7,954,440 | B2 * | 6/2011 | Joern | B29C 70/382 | 112/470.13 |

* cited by examiner

SEWING DEVICE AND SEWING METHOD

TECHNICAL FIELD

The present invention relates to a sewing device and a sewing method for implementing sewing on a skin material.

BACKGROUND ART

Sometimes, in order to create a high-quality feeling in a vehicle interior of an automobile, a skin material that has been cut or molded to match a shape of an interior base material of an instrument panel, or the like, undergoes implementation of stitch pattern sewing (is provided with a seam). The sewing has conventionally been performed by a worker using a fixed type sewing machine. In the sewing machine, a workpiece-to-be-sewn is disposed on a sewing machine table, and sewing is performed by a sewing machine needle through which a thread has been passed being caused to penetrate through and withdraw from that workpiece-to-be-sewn.

When performing such sewing, sometimes too, in order to prevent deformation, the sewing is performed with the workpiece-to-be-sewn fixed by a jig of a predetermined shape. For example, Japanese Laid-Open Patent Publication No. 2017-071382 relates to a method of forming a stitch pattern by a needle thread alone, and describes the workpiece-to-be-sewn being supported by a receiving jig.

SUMMARY OF INVENTION

However, in a conventional sewing device, which is for sewing a comparatively flat portion of the workpiece-to-be-sewn, a countermeasure for preventing interference of a curved workpiece-to-be-sewn and the receiving jig is not considered. Therefore, it is not possible for a pre-shaped workpiece-to-be-sewn to have the receiving jig disposed on its rear surface to undergo thread circulation, or for sewing such as chain stitching or lock stitching to be performed. Moreover, if the receiving jig is forcibly disposed, then there are problems such as the workpiece-to-be-sewn being damaged by the receiving jig, or there occurring positional misalignment of the seam.

The present invention has an object of providing a sewing device and a sewing method by which sewing can be performed on a shaped curved workpiece-to-be-sewn without the workpiece-to-be-sown being damaged.

One aspect of the present invention is present in a sewing device comprising: a plurality of seating portions disposed in a sewing direction, each of the seating portions being configured to, by a workpiece-to-be-sewn being seated on a seating surface thereof of a predetermined shape, hold the workpiece-to-be-sewn in a state of the workpiece-to-be-sewn having been shaped in a predetermined shape; a sewing mechanism configured to perform sewing on the workpiece-to-be-sewn by a sewing machine needle; a drive mechanism configured to move the sewing mechanism along a predetermined sewing line; and a retraction mechanism configured to, depending on a position of the sewing mechanism, retract at least some of the seating portions from the workpiece-to-be-sewn in a manner that interference of the sewing mechanism and the seating portions is avoided, the retraction mechanism including a guiding mechanism configured to, when the seating portions are retracted from the workpiece-to-be-sewn, perform movement in a first retracting direction for avoiding a first undercut portion of the workpiece-to-be-sewn and movement in a second retracting direction for avoiding a second undercut portion of the workpiece-to-be-sewn.

Yet another aspect of the present invention is present in a sewing method in which a sewing mechanism is employed to perform sewing along a predetermined sewing line on a workpiece-to-be-sewn in a state of the workpiece-to-be-sewn having been shaped in a predetermined shape, the sewing mechanism comprising: a sewing machine needle configured to, by moving in a reciprocating manner, penetrate through or withdraw from the workpiece-to-be-sown; a post bed that faces the sewing machine needle with the workpiece-to-be-sewn disposed therebetween; and a pressing mechanism configured to press the workpiece-to-be-sewn against the post bed from a side of the sewing machine needle, the sewing method comprising: a step of shaping the workpiece-to-be-sewn in the predetermined shape by the workpiece-to-be-sewn being seated on a plurality of seating portions disposed along the sewing line of the workpiece-to-be-sewn; a step of forming a retraction region where both surfaces of the workpiece-to-be-sewn have been set adrift, by retracting some of the seating portions; and a step of performing sewing with the both surfaces of the workpiece-to-be-sewn being pinched by the sewing mechanism, in the retraction region of the workpiece-to-be-sewn, wherein, in the step of forming the retraction region, interference of the seating portions and the workpiece-to-be-sewn is avoided by sequentially moving the seating portions in a first retracting direction of separating from a first undercut portion of the workpiece-to-be-sewn and in a second retracting direction of separating from a second undercut portion of the workpiece-to-be-sewn.

According to the above-described sewing device and sewing method, sewing can be performed on a shaped curved workpiece-to-be-sewn without the workpiece-to-be-sewn being damaged.

DESCRIPTION OF EMBODIMENTS

Figure 1:
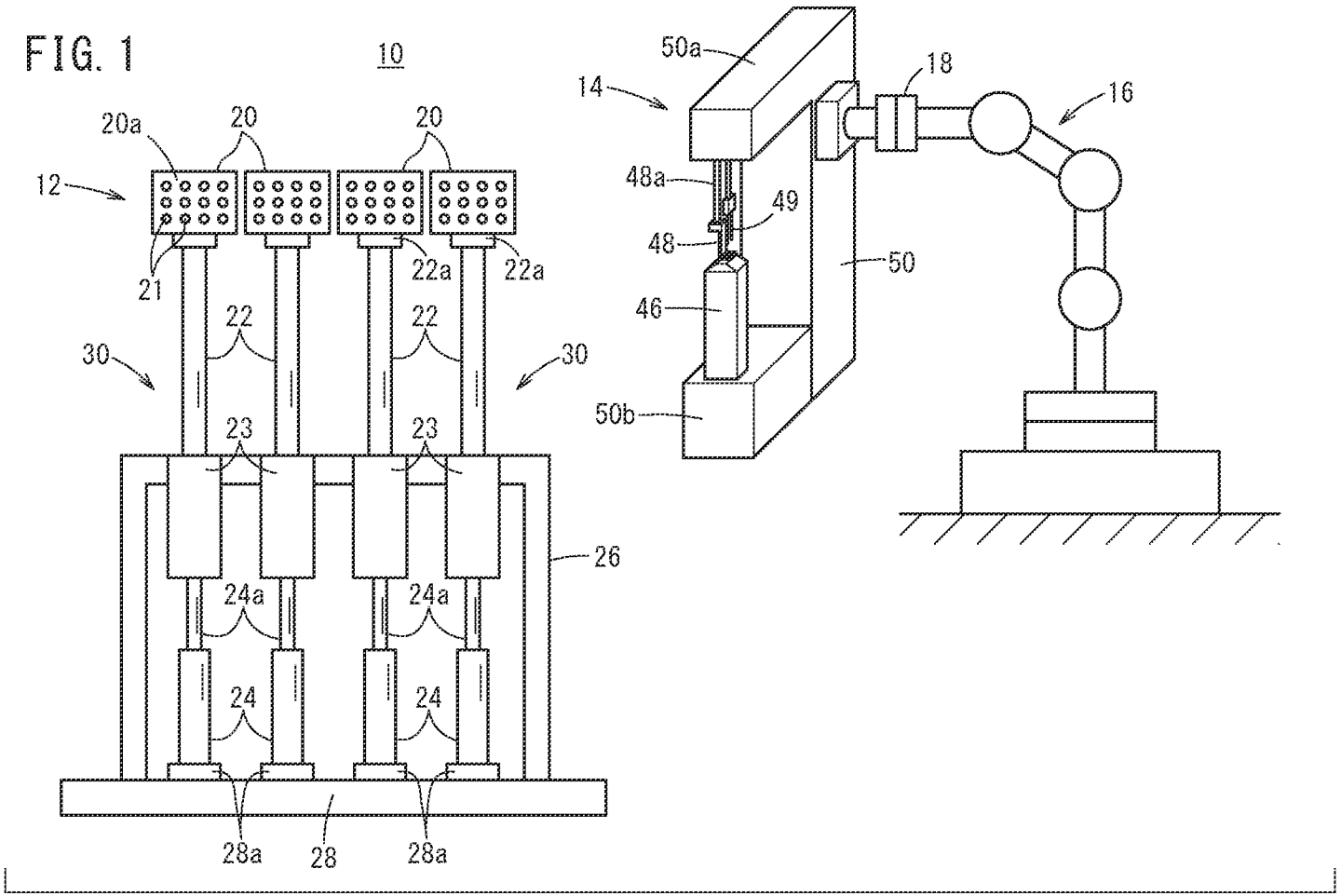
FIG. 1 is a schematic configuration diagram of a sewing device according to a first embodiment of the present invention.

A preferred embodiment of the present invention will be presented and described in detail below with reference to the accompanying drawings. Note that "up", "down", "left", and "right" in the description below respectively correspond to upward, downward, leftward, and rightward in the drawings. However, this is an indication of directions which has been adopted for convenience in order to facilitate understanding, and does not define directions when a sewing device, a workpiece holding jig, and a sewing method are actually used.

As shown in FIG. 1, a sewing device 10 according to an embodiment of the present invention includes: a workpiece holding jig 12; a sewing mechanism 14; and a conveyor robot 16 as a drive mechanism for conveying the sewing mechanism 14. The sewing mechanism 14 is fitted to a tip arm 18 of the conveyor robot 16.

The workpiece holding jig 12 comprises a seating portion 20, a retraction mechanism 30, and a frame 26. The seating portion 20 has a seating surface 20*a* formed in its upper portion. The seating surface 20*a* is formed in the same shape as a workpiece-to-be-sewn 58 (refer to FIG. 2 or FIG. 4), in order for shape of the workpiece-to-be-sewn 58 to be maintained. Note that in the example illustrated, the seating surface 20*a* includes in its uppermost portion a portion which is bent at an acute angle. That seating surface 20*a* has a plurality of suction holes 21 formed therein. These suctions holes 21 communicate with an unillustrated vacuum generating device via a negative pressure passage and a negative pressure system pipe 21*a* (refer to FIG. 2) on an inside of the seating portion 20. The seating portion 20 is configured so as to attach by suction, due to vacuum pressure, to the workpiece-to-be-sewn 58 placed thereon. The seating portion 20 is supported by a guide pin 22 via a core plate 22*a*.

Figure 4:
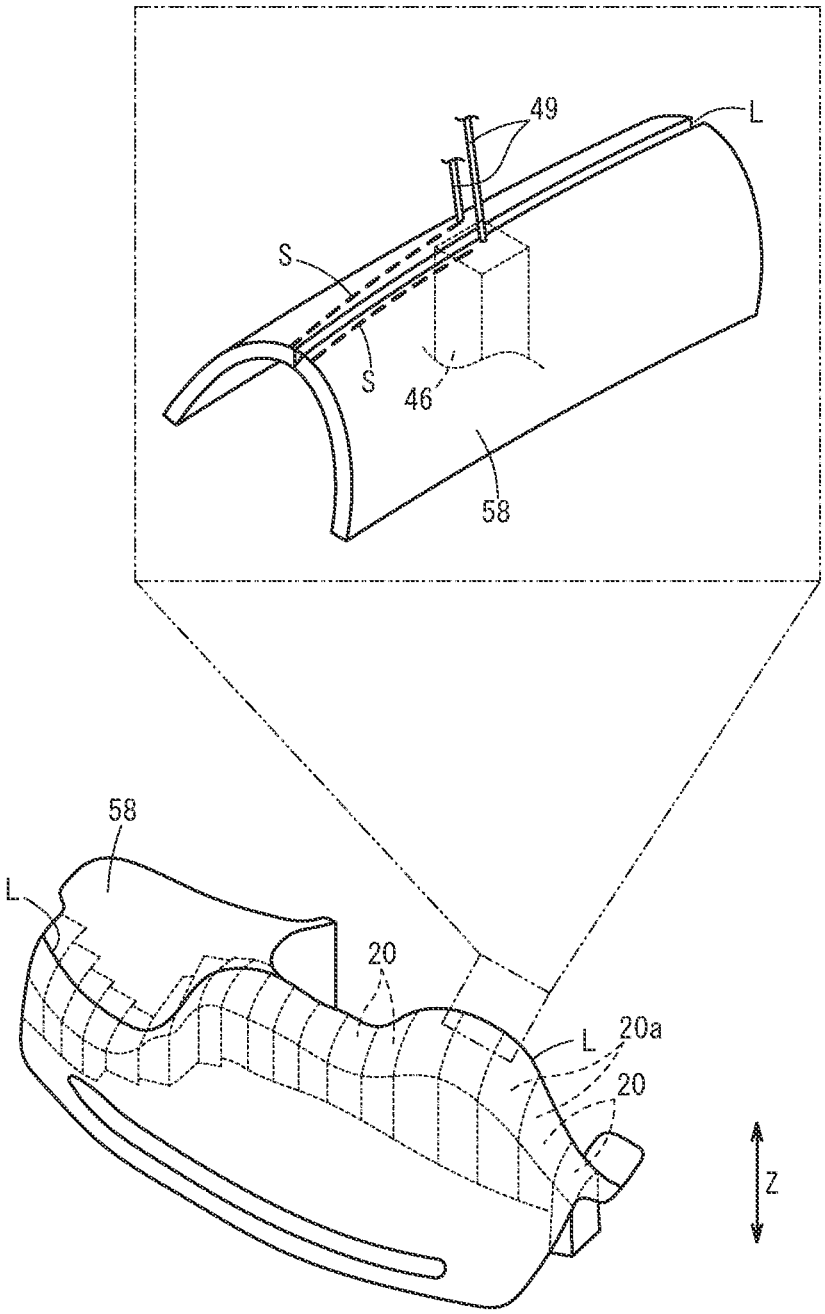
FIG. 4 is a perspective view showing a specific example of a workpiece-to-be-sewn sewn by the sewing device of FIG. 1, and the seating portions employed in that sewing.

A plurality of the seating portions 20 are disposed along a sewing direction of the sewing mechanism 14. Upper end portions of the seating surfaces 20*a* of these seating portions 20 are provided along a sewing line L (refer to FIG. 4) where the sewing mechanism 14 performs sewing, and have substantially the same shape as a shape of the workpiece-to-be-sewn 58 lying along the sewing line L. In the case where, for example, the workpiece-to-be-sewn 58 is a skin material of an instrument panel as shown in FIG. 4, the seating portions 20 are disposed in the portions indicated by broken lines in the drawing.

As shown in FIG. 1, the seating portions 20 are each provided with the retraction mechanism 30, and the individual seating portions 20 are configured to be retractable by their retraction mechanism 30. That is, the seating portions 20 are configured to be sequentially retractable with approach of the sewing mechanism 14.

As shown in FIG. 1, the retraction mechanism 30 comprises the guide pin 22, an air cylinder 24, and a guiding mechanism 23. The guiding mechanism 23 is fixed to a vicinity of an upper end of the frame 26, and is provided between the guide pin 22 and a piston rod 24*a* of the air cylinder 24. As will be mentioned later, the retraction mechanism 30 is configured in such a manner that the seating portion 20 is not displaced linearly, but is retracted on a curved path so as to avoid undercut portions 58*a*, 58*b* (refer to FIG. 5A) of the workpiece-to-be-sewn 58.

Figure 3B:
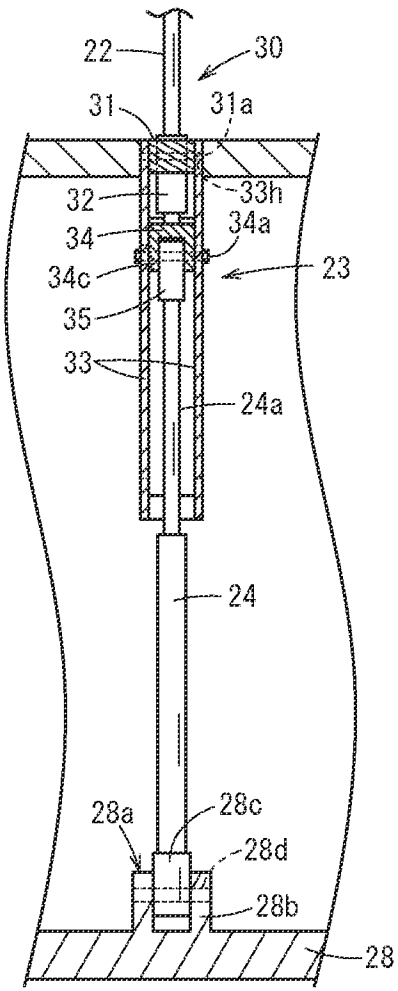
FIG. 3B is a cross-sectional view in which the guiding mechanism of FIG. 1 is shown seen from its front side.
Figure 3A:
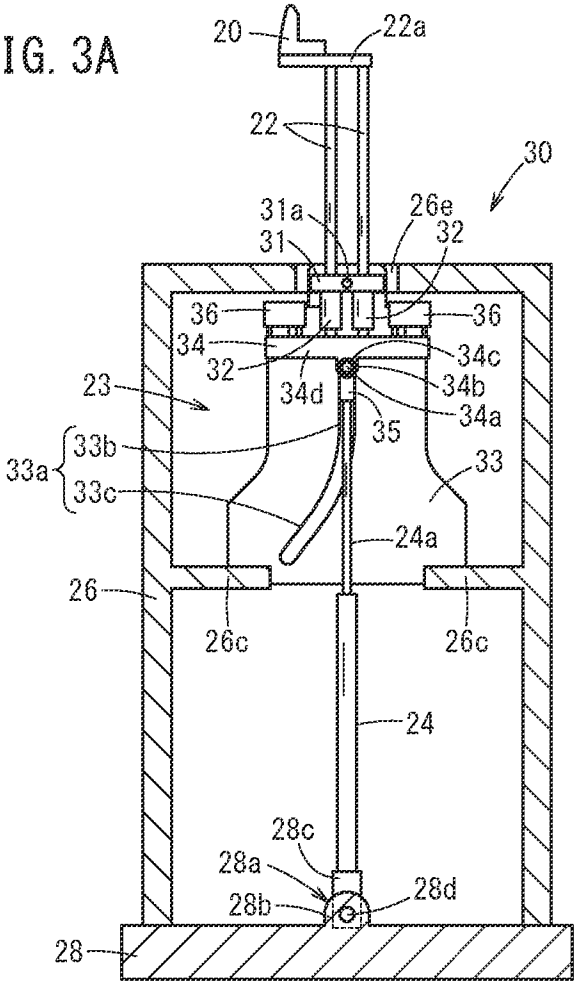
FIG. 3A is a cross-sectional view in which structure of a guiding mechanism of FIG. 1 is shown seen from its side.

As shown in FIG. 3A, the guide pin 22 is fitted to the frame 26 via a guide bush 32 and a seesaw portion 31 of the guiding mechanism 23. Moreover, a lower end portion of the guide pin 22 is connected to the piston rod 24*a* of the air cylinder 24 via a cylinder block 34 which will be mentioned later. The guide pin 22 is configured to be capable of moving in an up-down direction by the piston rod 24*a*, while being guided by the guide bush 32 of the guiding mechanism 23.

The air cylinder 24 has a base end portion fixed to a connecting portion 28*a* provided on a base portion 28 of the frame 26, and has a tip portion (its end portion on the piston rod 24*a* side) upwardly disposed. The piston rod 24*a* is configured to be capable of moving in an up-down direction of the drawing with operation of the air cylinder 24. This air cylinder 24 operates by compressed air supplied from outside via an air hose (unillustrated).

The air cylinder 24 is fitted to the base portion 28 via the rotatable connecting portion 28*a*, in such a manner that the air cylinder 24 is capable of tracking movement of the cylinder block 34 along a guiding slit 33*a*. As shown in FIG. 3B, the connecting portion 28*a* comprises a joint 28*c* which is inserted between a pair of supporting plates 28*b* provided separated in a width direction. The joint 28*c* is supported in a freely rotating manner by a supporting rod 28*d*. The base end portion of the air cylinder 24 is joined to the joint 28*c*.

As shown in FIG. 3A, the guiding mechanism 23 comprises the seesaw portion 31, the guide bush 32, a guide plate 33, the cylinder block 34, and a stopper mechanism 36.

The seesaw portion 31 is fitted to an inside of a fitting hole 26*e* provided in an upper end portion of the frame 26. The seesaw portion 31 is fixed to the guide plate 33 by a shaft pin 31*a*. The shaft pin 31*a*, which is a pair of columnar members extending out in a width direction from side portions of the seesaw portion 31, is inserted in hole portions 33*h* provided in the guide plate 33. The seesaw portion 31 is configured to be rotatable about an axis in a width direction (a direction perpendicular to a paper surface in FIG. 3A), around the shaft pin 31*a*.

The guide bush 32 is fixed to the seesaw portion 31. As shown in FIG. 3A, a pair of the guide bushes 32 are provided with the shaft pin 31*a* of the seesaw portion 31 disposed therebetween. The respective guide bushes 32 support the guide pins 22 in a manner that the guide pins 22 are freely insertable therethrough. The pair of guide bushes 32, which are configured to be inclinable in accordance with rotation of the seesaw portion 31, are capable of raising/lowering the guide pins 22 in a state that the guide pins 22 have been inclined.

As shown in FIG. 3B, a pair of the guide plates 33 are provided separated from each other in the width direction. Upper end portions of the pair of guide plates 33 are inserted in the fitting hole 26*e* of the frame 26, and respectively joined to inner walls of the fitting hole 26*e* by a method such as screw fastening. Moreover, lower end portions of the guide plates 33 are joined to supports 26*c* of the frame 26. The seesaw portion 31, the guide bushes 32, the cylinder block 34, and the stopper mechanism 36 are disposed between the pair of guide plates 33.

As shown in FIG. 3A, a principal surface of the guide plate 33 has the guiding slit 33*a* formed therein. The guiding slit 33*a* extends in an elongated manner in substantially an up-down direction, in order to guide a retraction operation of the seating portion 20. However, the guiding slit 33*a* includes therein: a first region 33*b* that guides the seating portion 20 in a direction for avoiding interference with a later-mentioned first undercut portion 58*a* (refer to FIG. 5A) of the workpiece-to-be-sewn 58; and a second region 33*c* that guides the seating portion 20 in a direction for avoiding interference with a later-mentioned second undercut portion 58*b* (refer to FIG. 5A) of the workpiece-to-be-sewn 58. The first region 33*b*, which is provided on an upper end side of the guiding slit 33*a*, and the second region 33*c*, which is provided on a lower end side of the guiding slit 33*a*, extend in different directions from each other. The first region 33*b* and the second region 33*c* are connected by a smooth curved line. Note that the guiding slit 33*a* including the first region 33*b* and the second region 33*c* may be configured by a plurality of straight lines bent at a bent portion.

As shown in FIG. 3B, the cylinder block 34 is disposed in the pair of guide plates 33. The cylinder block 34 has a main body 34*d* that moves between the pair of guide plates 33 while sliding along the guide plates 33. As shown in FIG. 3A, two guide pins 22 are joined to an upper end portion of the main body 34*d* of the cylinder block 34. Moreover, a central lower end portion of the cylinder block 34 has formed thereon a projection 34*c*, and the projection 34*c* is provided with a guide bearing 34*b*.

As shown in FIG. 3B, the guide bearing 34*b* is provided with a guiding pin 34*a* that projects in the width direction from the cylinder block 34, and the guiding pin 34*a* engages with each of the guiding slits 33*a* of the pair of guide plates 33. That is, a moving direction of the cylinder block 34 is configured so as to be restricted by the guiding pin 34*a* and the guiding slits 33*a*. Furthermore, as shown in FIG. 3A, the guide bearing 34*b* is fitted with a rod connecting portion 35 to which a tip portion of the piston rod 24*a* is connected. The rod connecting portion 35 is supported by the guide bearing 34*b* so as to freely rotate about an axis in the width direction (an axis in a direction perpendicular to the paper surface in FIG. 3A) with respect to the cylinder block 34.

Moreover, an upper portion of the guide plate 33 is provided with the stopper mechanism 36 that prevents upward movement of the cylinder block 34. The stopper mechanism 36 is joined by a method such as screw fastening, to the guide plate 33. The stopper mechanism 36 may be provided with: a damper that abuts on an upper surface of the cylinder block 34 to lower a moving speed of the cylinder block 34; and a hard stopper mechanism that prevents movement of the cylinder block 34. The stopper mechanism 36 is configured to prevent contact of the guiding pin 34*a* of the cylinder block 34 and an end portion of the guiding slit 33*a*, and thereby prevent damage of the guiding pin 34*a*.

As shown in FIG. 1, the sewing mechanism 14 comprises a main body 50 formed in a sideways-lying U shape in side view, and the main body 50 has projections 50*a*, 50*b* facing each other and provided with a post bed 46, a pressing mechanism 48, and a sewing machine needle 49. As shown enlarged in FIG. 2, the pressing mechanism 48 and the sewing machine needle 49 are provided on a side of one of the projections, that is, the projection 50*a*, and extend out toward the other of the projections, that is, the projection 50*b*. The post bed 46 is provided on a side of the other projection 50*b*, and extends out toward the pressing mechanism 48 and the sewing machine needle 49.

Figure 2:
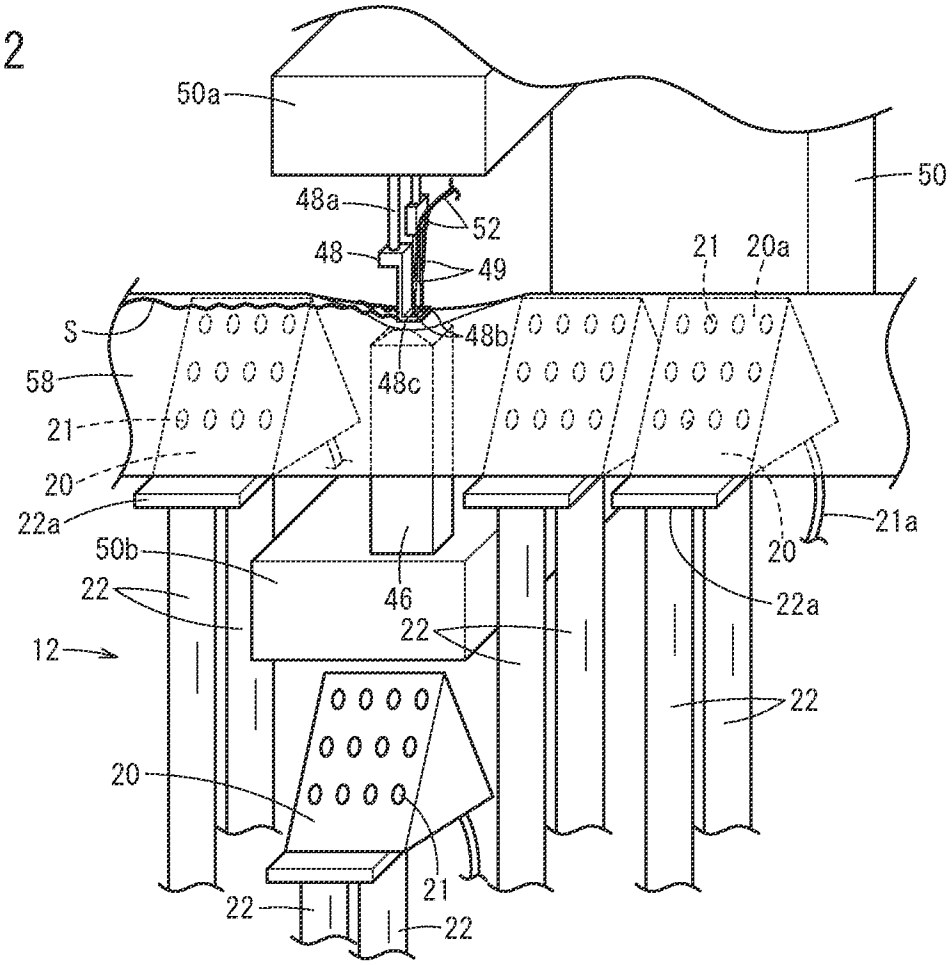
FIG. 2 is a perspective view in which seating portions and a sewing mechanism of the sewing device of FIG. 1 are shown enlarged.

As shown in FIG. 2, the pressing mechanism 48, which is configured projectable toward the post bed 46 via a shaft 48*a*, is configured in such a manner that, when sewing is performed on the workpiece-to-be-sewn 58, the pressing mechanism 48 presses the workpiece-to-be-sewn 58 against a tip of the post bed 46. A tip surface 48*c* of the pressing mechanism 48 is provided with a pair of through-holes 48*b* allowing insertion therethrough of a tip of the sewing machine needle 49.

The sewing machine needle 49 is fitted so as to be able to move in a reciprocating manner in the up-down direction by a drive mechanism (not unillustrated) of the projection 50*a*. Reciprocating movement of the sewing machine needle 49 describes an elliptical locus when viewed from a front of the main body 50. As a result, it is configured such that, even when the main body 50 is moved at a constant speed, the sewing machine needle 49 is penetrated through the workpiece-to-be-sewn 58 while maintaining a constant position with respect to the workpiece-to-be-sewn 58. The tip of this sewing machine needle 49 has a thread 52 inserted therethrough, and is inserted into a receiving portion of the post bed 46 via the through-hole 48*b*. Although not specifically limited, two items of the sewing machine needle 49 are provided in the drawing, and these can form two parallel stitch patterns S.

The post bed 46 is provided with an unillustrated looper that holds a loop portion of the thread 52 formed by entry of the sewing machine needle 49. That post bed 46 is configured in such a manner that thread circulation, in which the loop portion of the sewing machine needle 49 is caught on the next loop portion formed in an entering portion of the sewing machine needle 49 to connect up the loop portions, is performed, whereby sewing such as chain stitching or lock stitching is performed.

As shown in FIG. 1, the conveyor robot 16 is configured so as to convey the sewing mechanism 14 and move a sewing portion of the sewing mechanism 14 at a constant speed along the sewing line L (refer to FIG. 4). The conveyor robot 16 is configured so as to incline the main body 50 to match the shape of the workpiece-to-be-sewn 58 at a sewing position, and thereby maintain an inclination of the sewing mechanism 14 such that the sewing machine needle 49 will be substantially perpendicular to the sewing position of the workpiece-to-be-sewn 58.

The sewing device 10 according to the present embodiment is configured as above. The action along with the operation thereof will be described below.

As shown in FIG. 2, the workpiece holding jig 12 holds the workpiece-to-be-sewn 58 placed thereon, in a state of the workpiece-to-be-sewn 58 having been sucked by the suction holes 21 of the seating portions 20 and seated on the seating surfaces 20*a*. The sewing device 10 is configured so as to proceed with sewing by sequentially retracting the seating portions 20 according to a position of the sewing mechanism 14, and thereby disposing the post bed 46 on a rear side of the workpiece-to-be-sewn 58. In the case where the workpiece-to-be-sewn 58 is used in an interior material of a vehicle, the strength thereof is comparatively high, hence even if a rear surface of the workpiece-to-be-sewn 58 is merely partially seated on the seating portions 20, without the whole of it being seated thereon, posture can be maintained to a certain extent. Therefore, as illustrated, in a portion where the seating portion 20 has been retracted, there may also be a certain degree of elastic deformation with respect to pinching by the sewing mechanism 14.

As shown in the enlarged portion of FIG. 4, in order to prevent interference with the workpiece-to-be-sewn 58, the post bed 46 is disposed separated in a perpendicular direction from the rear surface of the workpiece-to-be-sewn 58, and may be separated by about 5 mm to 10 mm, for example. As a result, interference of the post bed 46 and the workpiece-to-be-sewn 58 is prevented, and deformation of the workpiece-to-be-sewn 58 is prevented, whereby positional misalignment from the sewing line L is prevented. As shown in FIG. 2, the pressing mechanism 48 is configured so as to push the workpiece-to-be-sewn 58 to a position of a tip surface of the post bed 46, thereby forming a flat surface on a surface of the workpiece-to-be-sewn 58 in a portion between the post bed 46 and the pressing mechanism 48, and adjusting the flat surface to be substantially perpendicular to the sewing machine needle 49.

The sewing mechanism 14 moves at a constant speed in a rightward direction of FIG. 2, for example, by the conveyor robot 16. Accordingly, the seating portion 20 at a position interfering with the sewing mechanism 14 is retracted. When the seating portion 20 is retracted, supply of negative pressure to the seating portion 20 is stopped, thereby releasing suction of the workpiece-to-be-sewn 58. Then, the air cylinder 24 is lowered to retract the seating portion 20 to a position not interfering with the sewing mechanism 14.

As a result, the workpiece-to-be-sewn 58 attains a state where both surfaces thereof have been set adrift from the seating portion 20, and to that portion, the sewing mechanism 14 can be moved along the sewing line L. Note that even when one seating portion 20 has been retracted, the shape of the workpiece-to-be-sewn 58 is maintained by the adjacent seating portions 20, hence sewing can be performed on the workpiece-to-be-sewn 58 in a shaped state thereof.

Moreover, the conveyor robot 16 (refer to FIG. 1) operates so as to move according to a pre-inputted teaching operation to maintain the inclination of the sewing mechanism 14 such that the sewing machine needle 49 of the sewing mechanism 14 will be substantially perpendicular to a surface of the sewing portion.

Incidentally, the workpiece-to-be-sewn 58 on which sewing is to be performed by the sewing device 10 is for example an interior material configuring an instrument panel of a vehicle having a shape like that shown in FIG. 4. In this case, the workpiece-to-be-sewn 58 is supplied to the sewing device 10 in a state of having been shaped in the shape of the instrument panel. This workpiece-to-be-sewn 58 is configured from: a hard base material that is made of a synthetic resin and has been formed in a required shape; and a soft skin material that has been adhered to a surface of the base material. The base material is constituted by extrusion-molded polypropylene, for example, and the skin material is constituted by a soft elastomer material that has been applied with a leather-like pattern, for example. In order for the stitch pattern S to be formed along the sewing line L where sewing is to be performed, the workpiece-to-be-sewn 58 is seated on the plurality of seating portions 20 disposed along the sewing line L.

Figure 5B:
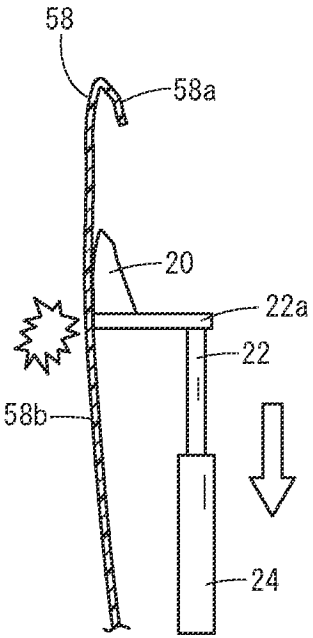
FIG. 5B is an explanatory drawing showing a problem in the case of the retracting direction of the seating portion being inappropriate.
Figure 5A:
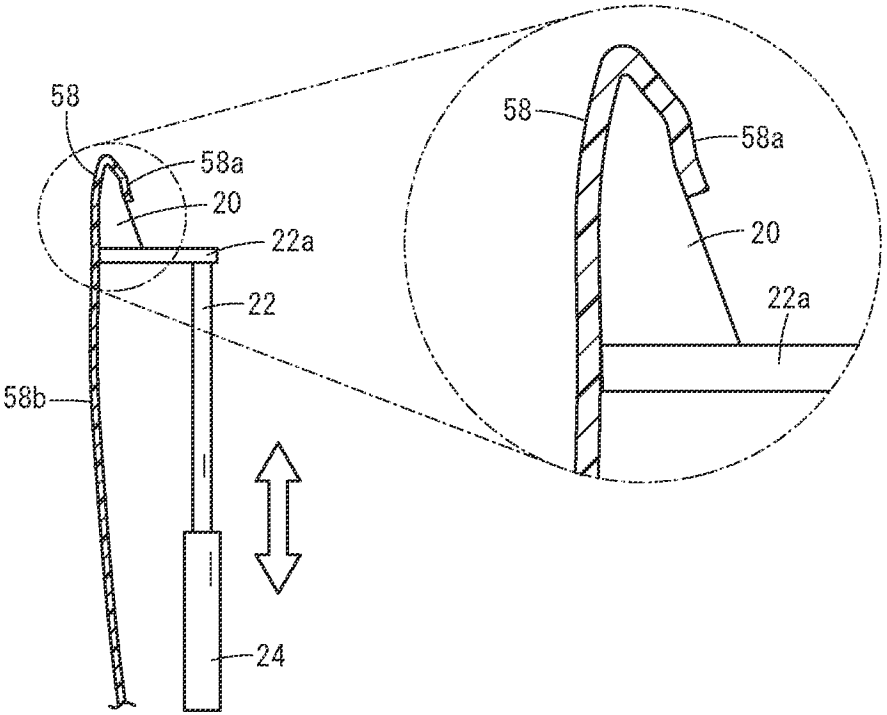
FIG. 5A is an explanatory drawing showing a reference example of a workpiece-to-be-sewn having undercut portions, and a retracting direction of the seating portion.

As shown in FIG. 5A, such a workpiece-to-be-sewn 58 sometimes includes the first undercut portion 58*a* formed in an inwardly wrapping-around manner, and the second undercut portion 58*b*. In order to avoid the first undercut portion 58*a* in the workpiece-to-be-sewn 58, it is conceivable that the seating portion 20 is retracted linearly in a direction of the outline arrows in the drawing. However, by linear displacement alone, sometimes, as shown in FIG. 5B, interference of the second undercut portion 58*b* and the seating portion 20 cannot be avoided, even if contact of the first undercut portion 58*a* and the seating portion 20 is avoided. Thus, there is a risk that, if the workpiece-to-be-sewn 58 and the seating portion 20 make contact, the workpiece-to-be-sewn 58 will receive damage, or misalignment will occur in the sewing position due to the workpiece-to-be-sewn 58 vibrating or being displaced, so that quality drops. Therefore, in the case of the seating portion 20 being retracted by linear movement alone, shape-related restrictions of the workpiece-to-be-sewn 58 end up increasing.

Accordingly, in the sewing device 10 of the present embodiment, the seating portion 20 is displaced along a path enabling the first undercut portion 58*a* and the second undercut portion 58*b* to be avoided, under action of the guiding mechanism 23.

Figure 6A:
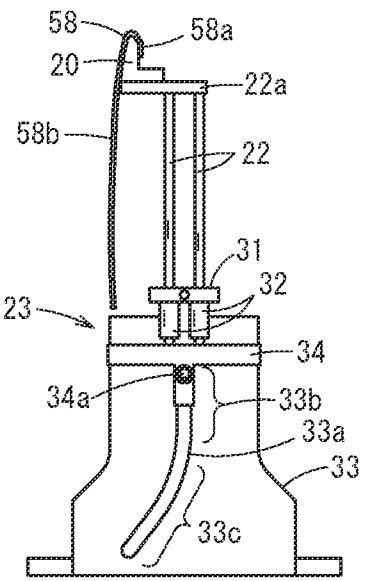
FIGS. 6A, 6B, 6C, and 6D are explanatory drawings showing a retraction operation of the seating portion of the sewing device according to the present embodiment on a workpiece-to-be-sewn having undercut portions.

In the state shown in FIG. 6A, the cylinder block 34 of the guiding mechanism 23 is positioned at an upper end, and, due to the guide pins 22, the seating portion 20 is disposed at a predetermined position, and the seating portion 20 holds the workpiece-to-be-sewn 58. Due to approach of the sewing mechanism 14, the retraction mechanism 30 of the workpiece holding jig 12 starts the retraction operation.

Figure 6B:
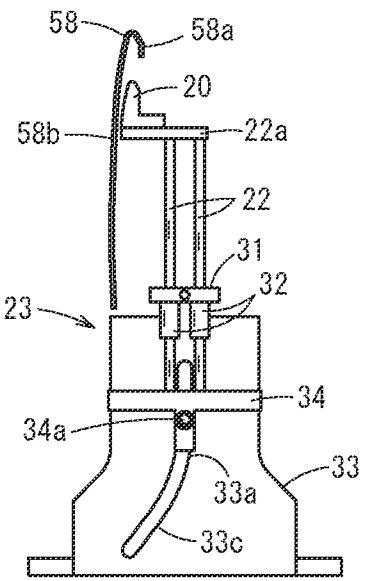

Due to the retraction operation, the piston rod 24*a* of the air cylinder 24 withdraws into the air cylinder 24, and, as a result, the cylinder block 34 descends, as shown in FIG. 6B. The guiding pin 34*a* of the cylinder block 34 moves along the first region 33*b* of the guiding slit 33*a*. In the example illustrated, the guiding pin 34*a* moves downwardly. Hence, the seating portion 20 is displaced in a first retracting direction of not abutting on the first undercut portion 58*a* of the workpiece-to-be-sewn 58. As a result, the seating portion 20 separates from the first undercut portion 58*a*, without contacting the first undercut portion 58*a*.

Figure 6C:
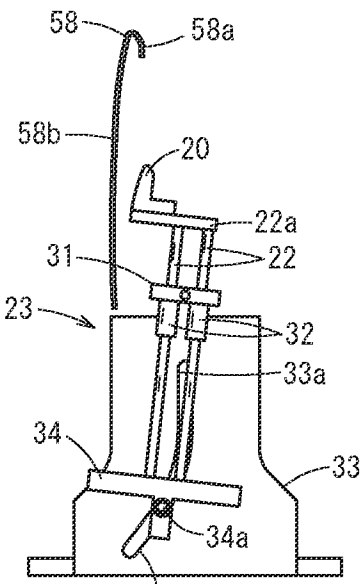

Upon the piston rod 24*a* of the air cylinder 24 further withdrawing, the guiding pin 34*a* of the cylinder block 34 enters the second region 33*c* of the guiding slit 33*a*, as shown in FIG. 6C. As a result, the cylinder block 34 and the guide pins 22 descend while inclining, as illustrated. Due to such displacement, the seating portion 20 is displaced in a second retracting direction of separating from the second undercut portion 58*b* of the workpiece-to-be-sewn 58. As a result, interference of the seating portion 20 and the second undercut portion 58*b* of the workpiece-to-be-sewn 58 is avoided.

Figure 6D:
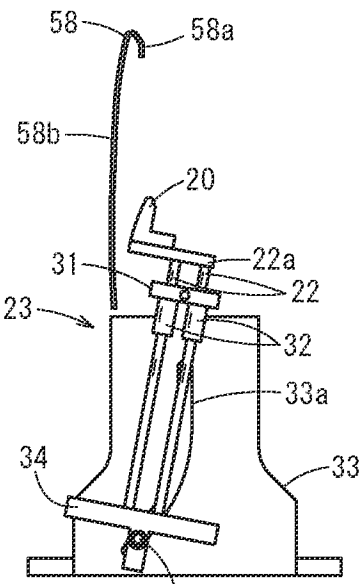

Upon the piston rod 24*a* of the air cylinder 24 further completely withdrawing, the cylinder block 34 moves to a vicinity of a lower end portion of the guide plate 33, whereby the retraction operation is completed, as shown in FIG. 6D.

The sewing device 10 of the present embodiment exhibits the following advantages.

The sewing device 10 includes the guiding mechanism 23 that, when the seating portion 20 is retracted from the workpiece-to-be-sewn 58, performs displacement in the first retracting direction for avoiding the first undercut portion 58*a* of the workpiece-to-be-sewn 58 and displacement in the second retracting direction for avoiding the second undercut portion 58*b* of the workpiece-to-be-sewn 58.

As a result, the sewing device 10 enables sewing using the seating portions 20 to be performed even on the workpiece-to-be-sewn 58 of complicated shape that has the plurality of undercut portions 58*a*, 58*b*, and that, in an operation of retracting the seating portion 20 in one direction alone, ends up interfering with the seating portion 20. Moreover, in the sewing device 10, the seating portion 20 and the workpiece-to-be-sewn 58 do not contact each other, hence damage of the workpiece-to-be-sewn 58 can be prevented, and misalignment of the sewing position accompanying contact of the seating portion 20 can also be prevented.

Moreover, the retraction mechanism 30 of the sewing device 10 may comprise: the guide pin 22 including a tip portion to which the seating portion 20 is connected; the seesaw portion 31 that supports the guide pin 22 in a manner that the guide pin 22 is rotatable about an axis in the sewing direction (the width direction); the guide bush 32 that is fitted to the seesaw portion 31, and that supports the guide pin 22 in a manner allowing the guide pin 22 to be inserted therethrough; and the driving unit that is connected to the base end portion of the guide pin 22 to raise/lower the guide pin 22.

As a result, the guide pin 22 can be raised/lowered in an inclined state, and it becomes possible to perform displacement in the first retracting direction for avoiding the first undercut portion 58*a* of the workpiece-to-be-sewn 58 and displacement in the second retracting direction for avoiding the second undercut portion 58*b* of the workpiece-to-be-sewn 58.

The guiding mechanism 23 of the sewing device 10 may comprise: the guide plate 33 including the guiding slit 33*a* whose leading portion and terminating portion extend in different directions; and the cylinder block 34 that is joined to the base end portion of the guide pin 22, and that is displaced while being guided by the guiding slit 33*a*.

Configuring in this way results in that, in the retraction operation, retraction can be performed while inclination of the guide pin 22 is changed, and interference of the seating portion 20 and the workpiece-to-be-sewn 58 can be prevented. In the above-described case, the driving unit may be a cylinder, and the piston rod 24*a* of the cylinder may be connected to the cylinder block 34.

In the sewing device 10, the tip portion of the piston rod 24*a* and the base end portion of the guide pin 22 may be connected via the cylinder block 34 so as to enable a bent shape to be formed by the piston rod and the guide pin.

As a result, linear displacement of the piston rod 24*a* of the air cylinder 24 is converted into a retraction operation along a bent or curved path.

In the sewing device 10, the cylinder block 34 may include: the main body 34*d* that slides along the guide plate 33; the guiding pin 34*a* that engages with the guiding slit 33*a* of the guide plate 33; and the rod connecting portion 35 fitted in a rotatable manner to the main body 34*d*.

Moreover, the sewing method of the present embodiment includes a step of forming a retraction region by sequentially moving the seating portions 20 in the first retracting direction of separating from the first undercut portion 58*a* of the workpiece-to-be-sewn 58 and in the second retracting direction of separating from the second undercut portion 58*b* of the workpiece-to-be-sewn 58. As a result, interference of the seating portions 20 and the workpiece-to-be-sewn 58 can be avoided.

In the above description, the present invention has been described by presenting the preferred embodiment thereof. However, the present invention is not limited to the above-described embodiment, and it goes without saying that various modifications thereof are possible in a range not departing from the spirit of the present invention.

What is claimed is:

1. A sewing device comprising:

a plurality of seating portions disposed in a sewing direction, each of the seating portions being configured to, by a workpiece-to-be-sewn being seated on a seating surface thereof of a predetermined shape, hold the workpiece-to-be-sewn in a state of the workpiece-to-be-sewn having been shaped in a predetermined shape;

a sewing mechanism configured to perform sewing on the workpiece-to-be-sewn by a sewing machine needle;

a drive mechanism configured to move the sewing mechanism along a predetermined sewing line; and a retraction mechanism configured to, depending on a position of the sewing mechanism, retract at least some of the seating portions from the workpiece-to-be-sewn in a manner that interference of the sewing mechanism and the seating portions is avoided, the retraction mechanism including a guiding mechanism configured to, when the seating portions are retracted from the workpiece-to-be-sewn, perform movement in a first retracting direction for avoiding a first undercut portion of the workpiece-to-be-sewn and movement in a second retracting direction for avoiding a second undercut portion of the workpiece-to-be-sewn.

2. The sewing device according to claim 1, wherein the retraction mechanism comprises:

a guide pin including a tip portion to which the seating portion is connected;

a seesaw portion configured to support the guide pin in a manner that the guide pin is rotatable about an axis in the sewing direction;

a guide bush that is fitted to the seesaw portion, and is configured to support the guide pin in a manner allowing the guide pin to be inserted therethrough; and a driving unit that is connected to a base end portion of the guide pin to raise/lower the guide pin.

3. The sewing device according to claim 2, wherein the guiding mechanism comprises:

a guide plate in which a guiding slit is formed; and a cylinder block that is joined to the base end portion of the guide pin, and is configured to be displaced while sliding along the guide plate, while being guided by the guiding slit.

4. The sewing device according to claim 3, wherein the driving unit is a cylinder, and a piston rod of the cylinder is connected to the cylinder block.

5. The sewing device according to claim 4, wherein a tip portion of the piston rod and the base end portion of the guide pin are connected via the cylinder block so as to enable a bent shape to be formed by the piston rod and the guide pin.

6. The sewing device according to claim 3, wherein the cylinder block includes: a main body configured to slide along the guide plate; a guiding pin configured to engage with the guiding slit of the guide plate; and a rod connecting portion fitted in a rotatable manner to the main body.

7. A sewing method in which a sewing mechanism is employed to perform sewing along a predetermined sewing line on a workpiece-to-be-sewn in a state of the workpiece-to-be-sewn having been shaped in a predetermined shape, the sewing mechanism comprising: a sewing machine needle configured to, by moving in a reciprocating manner, penetrate through or withdraw from the workpiece-to-be-sown; a post bed that faces the sewing machine needle with the workpiece-to-be-sewn disposed therebetween; and a pressing mechanism configured to press the workpiece-to-be-sewn against the post bed from a side of the sewing machine needle, the sewing method comprising:

a step of shaping the workpiece-to-be-sewn in the predetermined shape by the workpiece-to-be-sewn being seated on a plurality of seating portions disposed along the sewing line of the workpiece-to-be-sewn;

a step of forming a retraction region where both surfaces of the workpiece-to-be-sewn have been set adrift, by retracting some of the seating portions; and a step of performing sewing with the both surfaces of the workpiece-to-be-sewn being pinched by the sewing mechanism, in the retraction region of the workpiece-to-be-sewn, wherein in the step of forming the retraction region, interference of the seating portions and the workpiece-to-be-sewn is avoided by sequentially moving the seating portions in a first retracting direction of separating from a first undercut portion of the workpiece-to-be-sewn and in a second retracting direction of separating from a second undercut portion of the workpiece-to-be-sewn.

* * * * *